US005727482A

United States Patent [19]

Young

[11] Patent Number: 5,727,482

[45] Date of Patent: Mar. 17, 1998

[54] SUSPENDED VORTEX-CYCLONE COMBUSTION ZONE FOR WASTE MATERIAL INCINERATION AND ENERGY PRODUCTION

[76] Inventor: Bob W. Young, 102 Windham La., Easley, S.C. 29642

[21] Appl. No.: 666,858

[22] Filed: Jun. 19, 1996

[51] Int. Cl.[6] ..... F23G 5/00

[52] U.S. Cl. ..... 110/244; 110/235; 122/18

[58] Field of Search ..... 110/243, 244, 110/248, 251, 255; 122/18

[56] References Cited

U.S. PATENT DOCUMENTS

| | | | |
|---|---|---|---|
| 1,410,141 | 3/1922 | Thomas | 110/251 |
| 1,491,894 | 5/1924 | Atkinson | 110/226 |
| 3,437,324 | 4/1969 | Wellons | 432/68 |
| 3,536,018 | 10/1970 | Phelps | 110/244 |
| 3,577,940 | 5/1971 | Hasselbring et al. | 110/204 |
| 3,581,683 | 6/1971 | Collier | 400/200 |
| 3,675,600 | 7/1972 | Jones | 156/166 |
| 3,773,001 | 11/1973 | Bottalico | 110/257 |
| 3,858,534 | 1/1975 | Berg | 110/243 |
| 3,958,920 | 5/1976 | Anderson | 110/257 |
| 4,023,508 | 5/1977 | Cantrell, Jr. et al. | 110/243 |
| 4,027,602 | 6/1977 | Mott | 110/7 R |
| 4,262,611 | 4/1981 | Kuhnert et al. | 110/248 X |
| 4,323,018 | 4/1982 | Iwasaki | 110/208 |
| 4,385,567 | 5/1983 | Voss | 110/186 |
| 4,398,477 | 8/1983 | Iwasoki | 110/243 |
| 4,440,098 | 4/1984 | Adams | 110/205 |
| 4,444,127 | 4/1984 | Spronz | 110/235 |
| 4,509,435 | 4/1985 | Adams | 110/344 |
| 4,538,529 | 9/1985 | Temelli | 110/244 |
| 4,541,345 | 9/1985 | Grumpelt et al. | 110/229 |
| 4,632,042 | 12/1986 | Chang | 110/243 |
| 4,679,268 | 7/1987 | Gurries et al. | 110/346 |
| 4,724,776 | 2/1988 | Foresto | 110/214 |
| 4,870,912 | 10/1989 | Lee | 110/246 |
| 5,408,942 | 4/1995 | Young | 110/243 |
| 5,462,430 | 10/1995 | Khinks | 431/10 |
| 5,566,625 | 10/1996 | Young | 110/243 |

FOREIGN PATENT DOCUMENTS

| | | |
|---|---|---|
| 3733735 | 4/1989 | Germany . |
| 106162 | 8/1924 | Switzerland . |

*Primary Examiner*—Henry A. Bennett
*Assistant Examiner*—Pamela A. O'Connor
*Attorney, Agent, or Firm*—Carter & Schnedler, P.A.

[57] ABSTRACT

A system for waste-to-energy conversion of municipal solid waste and urban forest residue includes as a central element a vortex-cyclone suspended combustion zone furnace, supplied via a shredder and a rotary preheat kiln, and followed by a waste heat boiler. The combustion furnace takes the form of a horizontal tunnel-like structure into which solid waste material from the preheat kiln is introduced near an entry end, with separate exit ports for hot gas and ash at an exit end. The furnace has spaced horizontal waterwall tubes, between which forced draft air is injected in a circular pattern aided by vanes, producing a swirling overfire air curtain surrounding the vortex-cyclone suspended combustion zone along the length of the furnace. In the manner of a cyclone separator, a cylindrical structure surrounds the central exhaust gas opening, and extends from the exit end wall into the combustion chamber to a circular leading edge. This cylindrical structure minimizes non-combustible particulate content in the gas flow directed out through the central exhaust gas opening.

40 Claims, 6 Drawing Sheets

140
141
180
170
182
108
162
160
186
150
152
146
26
142
176C
189
176B
174C
188
176A
187
154
144
174B
172C
172B
185
174A
172A
148
184
5
4
3A
3B

SUSPENDED VORTEX-CYCLONE COMBUSTION ZONE FOR WASTE MATERIAL INCINERATION AND ENERGY PRODUCTION

BACKGROUND OF THE INVENTION

The invention relates generally to combustion apparatus for waste material incineration in general, toxic waste incineration, refuse burning, and power generation. The invention more particularly relates to combustion apparatus capable of supporting combustion temperatures in excess of 1100° C. (2000° F.) for essentially total combustion with minimal pollutant production.

The United States generates a growing volume of Municipal Solid Waste (MSW) and urban forest residue each year. 260 million tons of MSW and 200 million tires flow into landfills, constituting loss of substantial resources and creating major environmental problems for future generations. Only 16% of U.S. waste is burned in waste-to-energy (W-T-E) plants.

Currently-employed W-T-E technology meets resistance from residents living near proposed W-T-E sites because of perceived harmful emissions of gases and particulate matter, and production of large quantities of hazardous ashes that require utilization of landfills. Current research and development in W-T-E technology is devoted to off gas treatment with sorbent/dry spray scrubbing and baghouse filtering methods.

Environmental issues are of major importance in most combustion applications because waste materials contain compounds which, when improperly oxidized, and not collected, are air pollutants.

The mass burning method of MSW incineration has been used for over one hundred years and is still the predominant method. Waste material is injected into a "waterwall" furnace, generally without removing metals, water or other deleterious materials that can subdue combustion. Raw waste material falls onto a reciprocating furnace grate, which moves the waste material from front to back, and also tumbles the waste material to distribute combustion air. The mechanisms required to move and break up the waste material are extremely complex and expensive. If the waste material does not have a reasonably uniform heating value, problems can result within the furnace. At times there are areas of the grate where high-heating-value waste burns quickly. This concentrates combustion air on one area of the gate, while there is insufficient air flow through the grate in areas where the heating value of the waste is lower (usually because the waste is wetter). Uneven air distribution within the furnace results, and can cause reducing atmospheres, which leads to corrosion and/or high carbon monoxide levels.

Because there is no presorting of material being fed to the furnace, there is always the problem of pieces of metal, cables, and water tanks being fed into the furnace. This creates a potential erosion problem. Accordingly, the "waterwalls" of typical prior art MSW furnaces are covered with refractory linings to protect the tubes comprising the "waterwalls."

In brief summary, disadvantages of the prior art mass burning approach include: As all the waste is burned on the grate, temperatures on the grate are above the melting point of glass, and clinkers are formed. Combustion is inhibited because the MSW is injected into the furnace with water content of 25% or greater, thus lowering the BTU heating value. Because large metal objects are in the ash, pluggages in ash-discharge systems occur. Mechanical removal and recycling of metals and valuable products is virtually impossible. The use of water quenching for the ash produces an alkaline solution, which must be neutralized.

As another prior art method, Refuse Derived Fuel (RDF) has been burned in many forms since the early 1970's in an attempt to develop improved incineration methods and combustion quality as compared to mass burning. RDF has been burned in shredded (shred and burn), wet pulp, pelletized, and powder forms.

When wet RDF is burned after minimum shredding preparation (in boiler furnaces without grates, originally designed to burn pulverized coal and modified to burn RDF), excessive slagging and fouling occurs. Consequently, extensive separating of wet yard waste for landfilling is required.

Greater success has been achieved by shred and burn RDF waste-to-energy facilities that employ extensive removal of metals, glass, and other non-combustibles prior to incineration. These efforts require utilization of elaborate removal screens, magnetic separators, and spreader stoker grates. Unfortunately the refuse that is removed, as well as the water-quenched ash that results from incomplete combustion, must still be placed in landfills.

Over half of all RDF plants ever built have been closed due to such factors as difficulties in efficient burning of RDF, high maintenance and operating costs, and lack of available landfills for separated refuse and bottom ash.

SUMMARY OF THE INVENTION

Accordingly, it is an object of the invention to provide combustion apparatus which achieves more complete combustion, with reduced emissions and lower ash ratios compared to prior art waste material combustion systems.

It is another object of the invention to provide an overall system for waste-to-energy (W-T-E) conversion of municipal solid waste (MSW) and urban forest residue.

The foregoing and other objects are achieved by the present invention which, in accordance with an overall aspect, provides a system for processing and burning refuse-derived fuel. In a more particular aspect, a vortex-cyclone suspended combustion zone combustion furnace is provided. Vortex-cyclone combustion (VCC) of MSW results in thermal destruction of MSW with lower emissions and ash ratios.

In the overall system, incoming MSW is pretreated by shredding only to the minimum level required to make it easy to handle on conveyors. Prior to shredding, large metal objects are removed from the waste stream.

A rotary preheat kiln receives and preheats with oxygen-depleted hot gas the shredded waste material to be combusted. Thus, upon discharge from the Shredder, the waste material, which is now shredded refuse fuel (SRF), is delivered by conveyor directly to the rotary preheat kiln where the SRF is heated by oxygen-depleted furnace exhaust gases to its ignition temperature. To allow the preheat kiln to be maintained at different pressure and gas content compared to the rest of the system, one air seal auger feeder feeds material to be combusted from a solid waste material supply conveyor into the preheat kiln, while preventing the passage of gas, and another air seal auger feeder feeds preheated material from the preheat kiln into the combustion furnace, while also preventing the passage of gas.

In the overall system, there is a waste heat boiler downstream of the combustion furnace for deriving energy from hot gas exiting the combustion furnace. A hot gas supply conduit is connected downstream of the waste heat boiler for drawing a portion of the hot gas produced as a product of combustion, and circulating this hot gas through the preheat kiln. A gas-return duct from the preheat kiln to the vortex-cyclone combustion furnace includes a condensing system to minimize the amount of water which enters the furnace.

Dry, heated SRF is then passed through a rotary air-seal auger chamber into the vortex-cyclone furnace, wherein that portion of the SRF which comprises aerodynamic combustible particulate matter (organics, paper, and plastics) is drawn into a combustion vortex. The lighter combustible materials ignite and burn in suspension. Heavier material (mostly noncombustibles such as metals and glass, but including pieces of wood and other heavy combustibles) falls to a slowly moving floor grate conveyor. Because most of the SRF is burned in suspension, the floor grate can be much smaller than is required for mass burning incineration. For example, the floor grate can be one-third the size of a grate in a mass burn incinerator of similar capacity.

The subject system reduces the cost of extensive separation of wet yard waste and recyclables such as ferrous metals. Yard waste may be used for fuel, particularly since water is removed by kiln drying. Paper and plastics can be used for fuel rather than recycling, as the value of the energy produced is greater than the value of these materials for recycling.

Preferably the combustion apparatus takes the form of a horizontal tunnel-like structure wherein solid waste material from the preheat kiln is introduced near an entry end and exit ports for hot gas and ash are provided an exit end. In addition, an entry point for hydrocarbon fuel such as oil, natural gas or powdered coal may be provided near where solid waste material is introduced. At the exit end is an end wall having a central exhaust gas opening, with a lower outlet opening at the exit end for non-combustible particulates. During operation, centrifugal separation force tends to direct non-combustible particulates to the lower outlet opening and to direct gas flow with reduced non-combustible particulate content out through the central exhaust gas opening. The lower outlet opening below the central exhaust opening communicates with a recovery hopper, which is maintained at a lower pressure than the combustion chamber. Non-combustible particulate matter thus enters the recovery hopper.

More particularly, the combustion furnace includes walls defining a combustion chamber having a vortex-cyclone suspended combustion zone, whereby centrifugal force created by the cyclone effect moves non-combustible particulate matter to the outside of the combustion zone, and vortex motion provides increased gas residence and particulate contact time. Vortex-cyclone combustion (VCC) provides three times more gas-residence and particulate-contact time within the combustion zone at temperatures exceeding 1000° C. compared to prior art mass-burn and RDF furnaces. The vortex pattern lengthens gas and particulate travel distance from front to rear of the furnace as a result of the circular pattern produced by the vortex. Extended gas-residence and particulate-contact time allows more complete combustion and reduction of VOC and CO emissions. Residue ash ratio is reduced to less than 5%. A lower excess air requirement enables the vortex cyclone to burn at higher temperatures, further enhancing heat transfer and therefore efficiency. Slagging on furnace walls is virtually nonexistent.

At least a portion of each of the walls, which may be viewed as "waterwalls," takes the form of a plurality of tubes which are adjacent and spaced from each other. The tubes have tube interiors and tube walls, and at least one heat exchange fluid supply pump is connected to the tubes for circulating heat exchange fluid, such as water, through the tubes. Typically, the tubes comprise metal, and at least portions of the walls are free of refractory materials. However, in some embodiments, the tubes comprise a refractory material, such as silicon carbide.

Relatively high combustion temperatures are sustained by providing excess combustion air, the same combustion air which maintains the suspended vortex-cyclone combustion zone. The corresponding heat energy is transferred to the waterwall heat exchanger tubing of the chamber sidewalls.

A system, such as a set of air manifolds, directs combustion-supporting gas streams between at least some of the tubes into the combustion chamber. The pressurized manifolds preferably are divided into several differently pressurized zones, for example supplied by separate blowers, such that combustion air is supplied at different rates from different zones, such that different ratios of combustion-supporting gas to fuel are achieved within different portions of the combustion zone. This facilitates adjustment of combustion parameters, including air staging for $NO_x$ control.

Vanes are attached to the tubes for tangentially directing the combustion-supporting gas streams into the combustion chamber for promoting vortex gas flow and for producing an overfire gas curtain around the combustion zone.

The VCC zone is thus created by injecting air streams through the spaces between the waterwall heat exchange tubes in a circular pattern, which forms a swirling overfire air curtain surrounding the vortex-cyclone suspended combustion zone, the full length of the furnace. The circular air-flow pattern induces the vortex-cyclone effect, aided by an exhaust draft boost fan which produces a negative pressure within the combustion chamber.

A combustion chamber drag conveyor conveys heavier non-suspended objects and non-combusted particles towards the exit end, to ultimately enter the recovery hopper and an ash collection system. The combustion chamber drag conveyor more particularly includes conveyor elements which are driven over a floor grate having spaced grate elements between which combustion-supporting gas streams are directed upwardly.

Somewhat in the manner of a cyclone separator, a cylindrical structure surrounds the central exhaust opening, and extends from the exit end wall into the combustion chamber to a circular leading edge. This cylindrical structure minimizes non-combustible particulate content in the gas flow directed out through the central exhaust gas opening.

The cylindrical structure includes a wall cooled by circulating heat exchange fluid. In one embodiment, the end wall comprises a plurality of tubes through which heat exchange fluid is circulated, and a flow path for circulating heat exchange fluid (water) includes at least some of the end wall tubes and the cylindrical structure. Thus, the cylindrical structure includes a hollow wall within which heat exchange fluid circulates. In one particular construction, there are a plurality of conduits within the hollow wall conveying heat exchange fluid within the conduits towards the leading edge, and discharging heat exchange fluid into the interior of the hollow wall near the leading edge.

BRIEF DESCRIPTION OF THE DRAWINGS

While the novel features are set forth with particularity in the appended claims, the invention, both as to organization and content, will be better understood and appreciated from the following detailed description, taken in conjunction with the drawings, in which:

DETAILED DESCRIPTION

Figure 1:
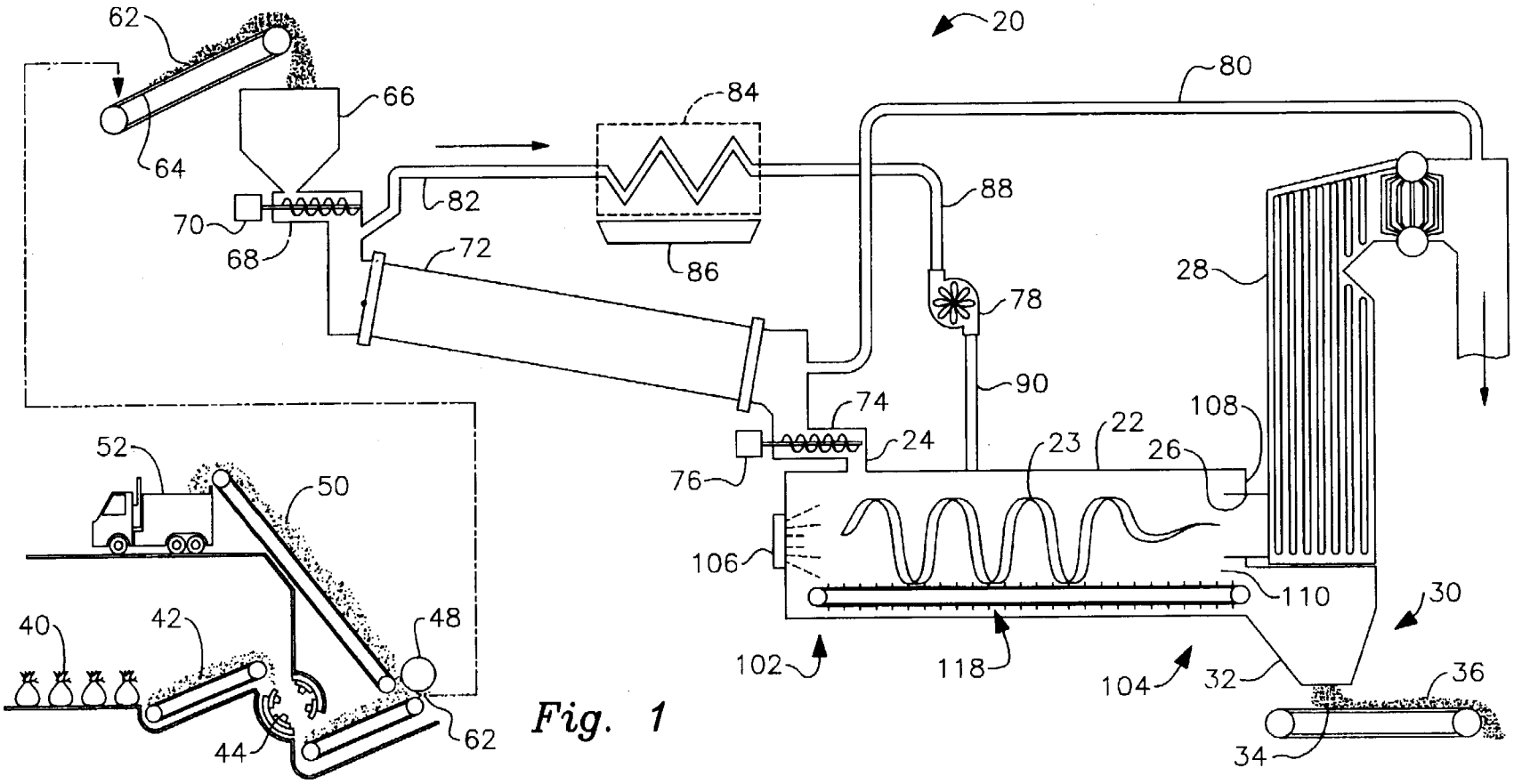
FIG. 1 is a diagrammatic overview of a system in accordance with the invention for processing and burning refuse-derived fuel, such as municipal solid waste for waste-to-energy conversion.

Referring initially to FIG. 1 for an overview, a solid waste material incinerator system for burning refuse-derived fuel is generally designated 20. Central to the system 20 is a combustion furnace 22 including a combustion chamber having a suspended vortex-cyclone combustion (VCC) zone represented by a gas spiral 23. The combustion furnace 22 has a solid waste material entry port 24 located on top of the furnace 22, a hot gas exit port 26 connected to an exhaust gas system 28, and an ash and metals collection system, generally designated 30. The exhaust gas system 28 comprises, for example, a waste heat boiler 28 for generating steam for power, and air pollution control equipment (not shown). Also not shown is a conventional exhaust draft boost fan downstream of the waste heat boiler 28.

Thus in most cases, the exhaust gas system 28 includes an exhaust gas scrubber of appropriate configuration. Typically, a baghouse filter system is employed to remove fly ash. In applications where combustion apparatus of the invention is retrofitted to convert existing coal-fired power plants, no additional equipment is necessary for preparing exhaust gases for entry into the atmosphere; existing exhaust gas scrubbing equipment can be retained. Nevertheless, it is significant that the amount of fly ash and other particulates which can coat surfaces within the waste heat boiler 28 is greatly reduced by the cyclone separator aspect of the invention described hereinbelow.

The ash collection system 30 includes a hopper 32 maintained at negative pressure, and a conveyor 34 which conveys bottom ash 36 to a dry ash processing unit (not shown) which separates out ferrous metals, non-ferrous metals and boiler aggregate, as examples.

Incoming municipal solid waste (MSW) is represented in FIG. 1 by bags 40, the contents of which are conveyed along a conveyor 42 to a shredder 44, which shreds the municipal solid waste (MSW) only to the minimum level required to make it easy to handle on conveyors. A hammermill type shredder 54 may be employed. The shredded waste is carried by a conveyor 46 past a magnet 48 which separates out ferrous metals that are carried by a conveyor 50 to a representative truck 52 for recycling.

What may be termed shredded refuse fuel 62 (SRF) continues on and is then delivered by a conveyor 64 into a hopper 66 and through an air seal auger feeder 68 driven by a motor 70 into a waste material rotary preheat kiln 72. The waste material rotary preheat kiln 72 discharges into the interior of the combustion furnace 22 through the port 24, via another auger feeder 74 driven by a motor 76.

The solid waste entry port 24 is sized to accommodate shredded solid waste injected into the combustion furnace 32. For example, forest waste products and municipal foliage waste may range in size up to four inches cross-sectional diameter. Bagged household garbage and trash objects are shredded into four inch square pieces.

The rotary preheat kiln 72 rotates at speeds of one to two revolutions per minute, which causes the shredded waste to tumble and separate, exposing shredded waste particles to exhaust heat drawn into the kiln 72 via a blower 78 located near the furnace 22. During multiple revolutions within the kiln 72 the shredded waste is dehydrated and preheated to ignition temperature. Shredded solid waste material is tumbled within the kiln 72 towards the combustion chamber screw feed entry port 24. At the very least this accomplishes drying and heating of the shredded solid waste material. Preferably, the temperature of shredded solid waste material is raised to near its flash point as the solid waste material is injected into the combustion chamber 22 by gravity and pneumatic assist.

It is thus a feature of the invention that waste material moving through the preheat kiln 72 is preheated and dehydrated prior to being introduced into the combustion chamber 22. More particularly, oxygen-depleted gas is drawn from the waste heat boiler 28 exhaust via a conduit 80 into the preheat kiln 72, and then via a conduit 82 through a condenser 84, shown in a highly diagrammatic form with a water-collection tray 86 located therebelow, and then through a conduit 88, drawn into the fan 78 and ejected via a conduit 90 into the combustion furnace 22.

Figure 2:
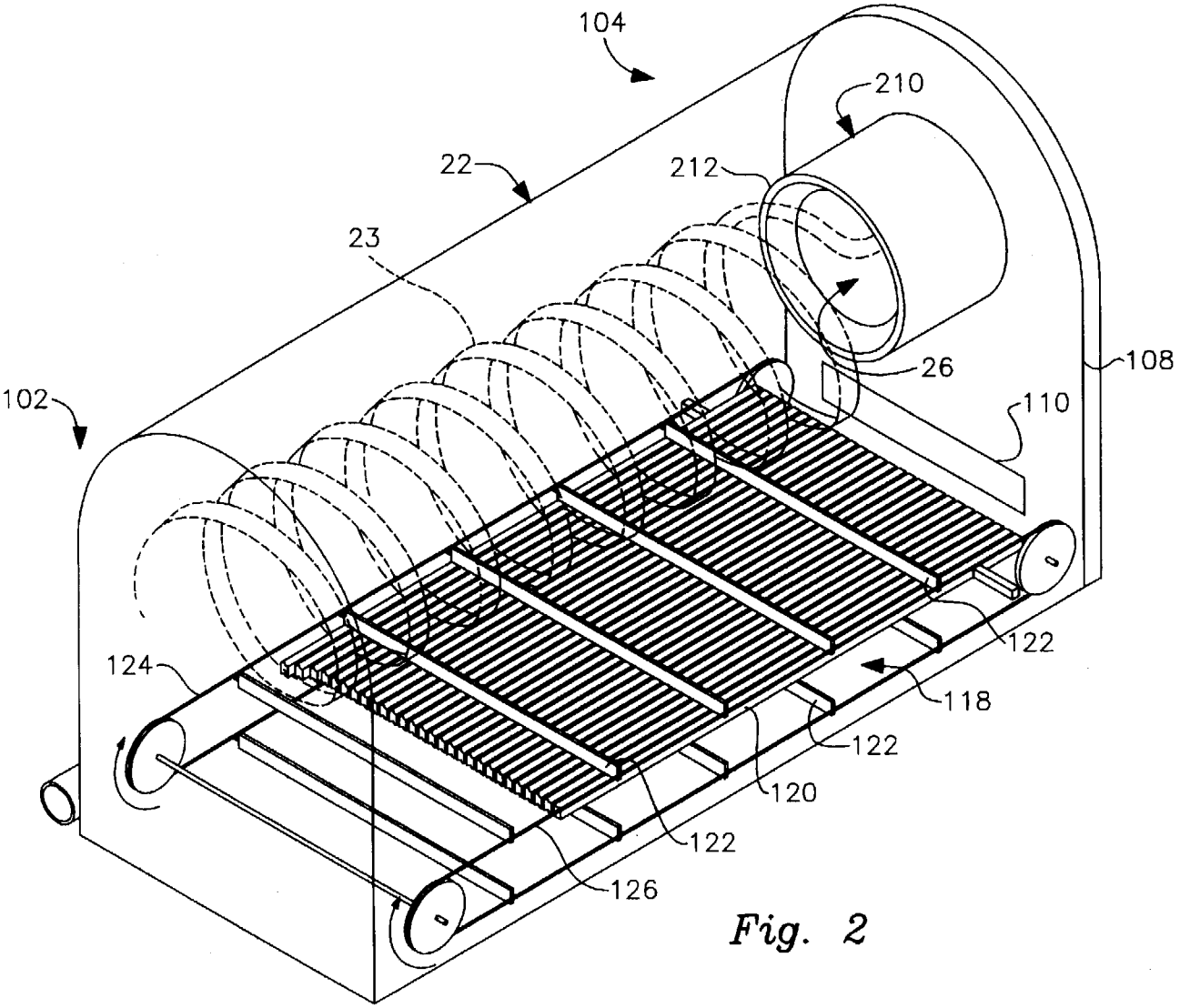
FIG. 2 is a three-dimensional conceptual diagram depicting gas flow within the combustion chamber.

Considering the combustion furnace 22 in greater detail, and referring also to FIG. 2, the furnace 22 takes the form of a horizontal tunnel-like structure having an entry end 102 and an exit end 104. At the entry end 102 there is an auxiliary fuel burner 106 (FIG. 1), which may comprise oil injection nozzles or gas burners, ignited by sparking devices (not shown) for at least initiating the combustion process. Gas supply jets and sparking devices also may be mounted at various locations along the lower portion of the combustion chamber.

At the exit end 104 is an end wall 108 having the central exhaust gas opening 26, as well as a lower outlet opening 110 for non-combustible particulates. In FIG. 2, the vortex-cyclone combustion (VCC) zone 23 represented by the gas spiral flows towards the exit end 104.

Along the bottom of the furnace 22, is a drag conveyor 118 which conveys non-suspended objects towards the exit end 104, and discharges non-combustible material through the lower outlet opening 110 into the hopper 32. The drag conveyor accordingly serves the dual purposes of conveying heavy objects through the combustion apparatus 22, which heavy objects are too heavy for the suspended vortex-cyclone combustion zone 23, and of conveying non-combusted particles to the ash collection and metals collection system 30.

The drag conveyor 118 more particularly comprises a grate in the form of a series of longitudinally-extending bars 120, spaced laterally from each other, and a series of laterally extending drag elements 122 (scraper blades 122) attached at their ends to representative sprocket-driven chain drives 124 and 126 which move the scraper blades 122 along the bars 120. The floor grate elements 120 by way of example comprise strips of steel oriented on edge and running substantially the entire length of the combustion chamber. Preferably, the chains 124 and 126 are the type commonly employed for driving the tracks of tracked vehicles, and which accordingly have attachment points suitable for the scraper blades 122. Although not illustrated, in order to avoid overheating of the chains 124 and 126, preferably there is a chain chamber (not shown) into which cooling air is injected. The drag conveyor 118 is driven by one or more variable speed, reversible electric or hydraulic motors (not shown). Conveyor speed may vary according to the type and size of waste material being combusted.

Referring now also to FIGS. 3, 3A, 3B, 4 and 5, the combustion apparatus 22 more particularly comprises a horizontal, tunnel-like combustion chamber within which the vortex cyclone combustion zone 23 is defined. The combustion chamber has walls made of a plurality of steel boiler tubes 140 having tube interiors 141. The tubes 140 are adjacent and spaced from each other, and extend horizontally between a pair of arched headers 142 and 144 having respective horizontal lower sections 146 and 148, thus defining a waterwall furnace. A heat exchange fluid such as water is driven by a pump 150 via a conduit 152 into the lower section 146 of the header 142, and heated water exits the furnace via the header 144 and an exit conduit 154 after flowing horizontally through the tubes 140 from header 142 to header 144. Water thus flows in the opposite direction with reference to combustion vortex flows, and continues on to the main boiler 28. Water is supplied to the pump 150 from a condenser (not shown) following a steam turbine or other power generator (not shown).

The exit end wall 108 comprises a plurality of vertically extending waterwall tubes 160, extending between the upper arch portion of the header 142 and the horizontal lower section 146. Water flow within these end wall tubes 160 is from the lower section 146 upwardly to the arch portion 142. Spaced from these vertically-extending tubes 160 is a wall 162 of reflective refractory material 162, which serves to reflect heat against the rear portions of the vertical tubes 160 for improved heat transfer.

It will be appreciated that the depicted organization of the various waterwall tubes is a simplified representation, as various auxiliary conduits may be provided to promote uniform water flow through various waterwall tubes.

Surrounding the horizontal waterwall tubes 140 is a series of forced draft air supply manifolds 170, supplied by a series of air supply conduits 172A, 174A, 176A, 178A, 172B, 174B, 176B, 178B (corresponding to 178A but not visible), 172C, 174C, 176C and 178C (corresponding to 178A but not visible). Combustion air is thus directed through the spaces 179 between the waterwall tubes 140 into the combustion zone. To achieve high velocity air injection, the spacing between the waterwall tubes is relatively small. A typical spacing is 0.025 inch between tubes which are three inches in diameter. A series of vanes 180 are affixed to the waterwall tubes 140 to direct these combustion-supporting gas streams into the combustion chamber in a direction which promotes vortex gas flow, producing an overfire gas curtain around the combustion zone. Only about half of the spaces 179 between the waterwall tubes 140 have forced draft air supply manifolds 170, and the other spaces are blocked by reflective refractory material 182, spaced from the tubes 140 such that combustion heat is reflected onto the back of the tubes 140.

Centrifugal force created by the cyclone effect causes non-combustible particulate matter (ash) to move to the perimeter of the vortex. The ash generally bypasses the exit port 26 and does not enter the boiler 28. This action allows non-combustibles to fall to the drag conveyor 118 and then to be drawn into the collection hopper 32, thus reducing heat exchanger wear, slagging and fouling.

To further promote the vortex cyclone gas flow motion within the combustion zone, the exhaust draft boost fan (not shown), located downstream from the boiler 28, creates a negative pressure within the furnace 22 which produces a draft within the combustion chamber. The draft-induced movement of gas within the combustion chamber causes a horizontal vortex (i.e. gas spiral 23) to form the full length of the combustion chamber, aided in part by the Coriolis force. The vortex motion is accelerated by the circular air flow induced by the tangentially directed air forced through the space 179 between the heat exchange waterwall tubing 140 surrounding the combustion zone.

Preferably, to facilitate the adjustment of combustion parameters, including air staging for $NO_x$ control, the forced draft air supply manifolds 170 are zoned both longitudinally along the length of the combustion chamber and peripherally in zones around the structure. In the illustrated configuration, twelve different air supply zones are provided. Thus different air-to-fuel ratios are achieved within different portions of the combustion zone 23.

Figures 3, 3A, 3B:
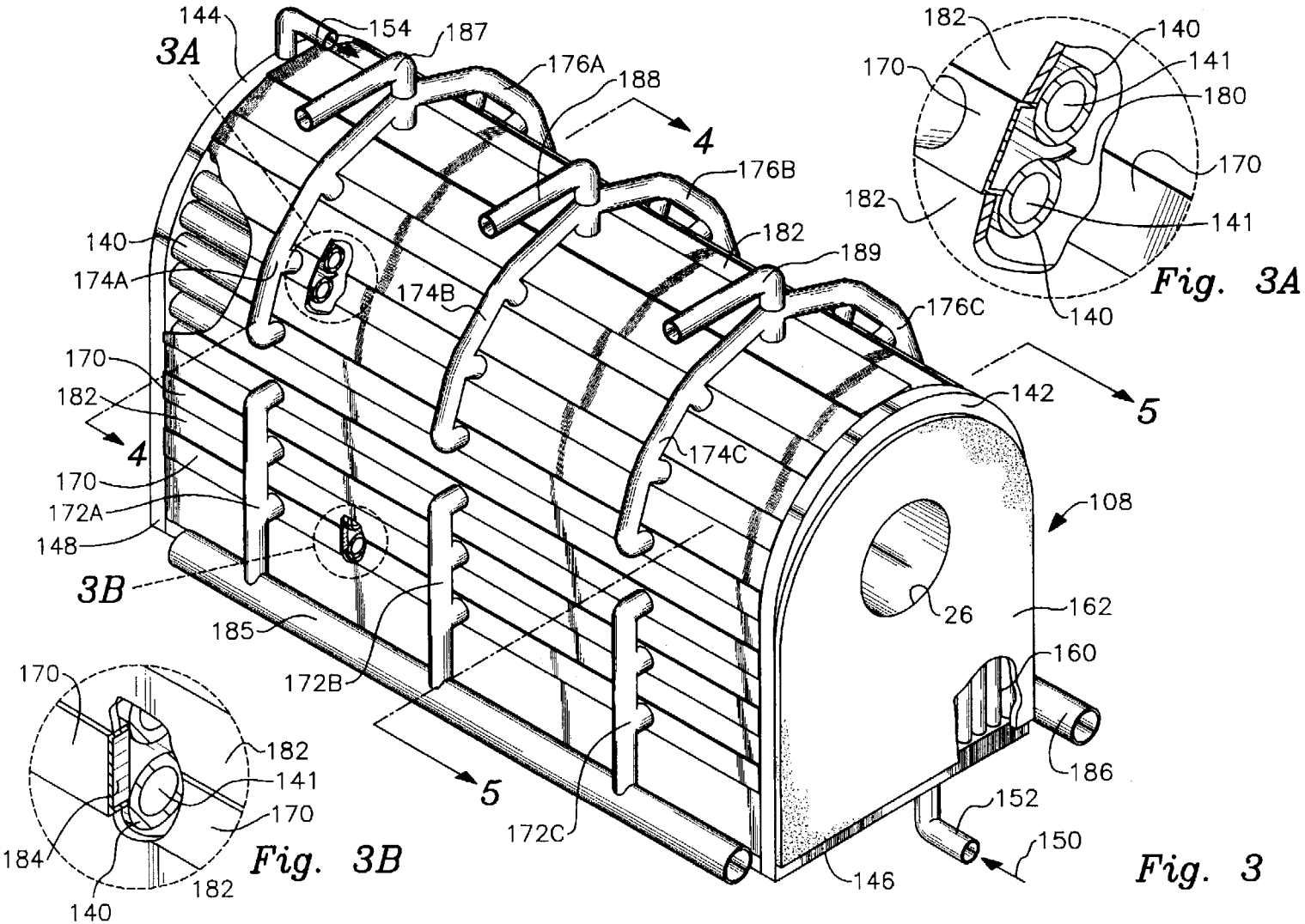
FIG. 3 is a three-dimensional view of the exterior of the combustion chamber, with portions broken away to show internal details.
FIG. 3A is an enlargement of portion 3A of FIG. 3.
FIG. 3B is an enlargement of portion 3B of FIG. 3.
Figure 4:
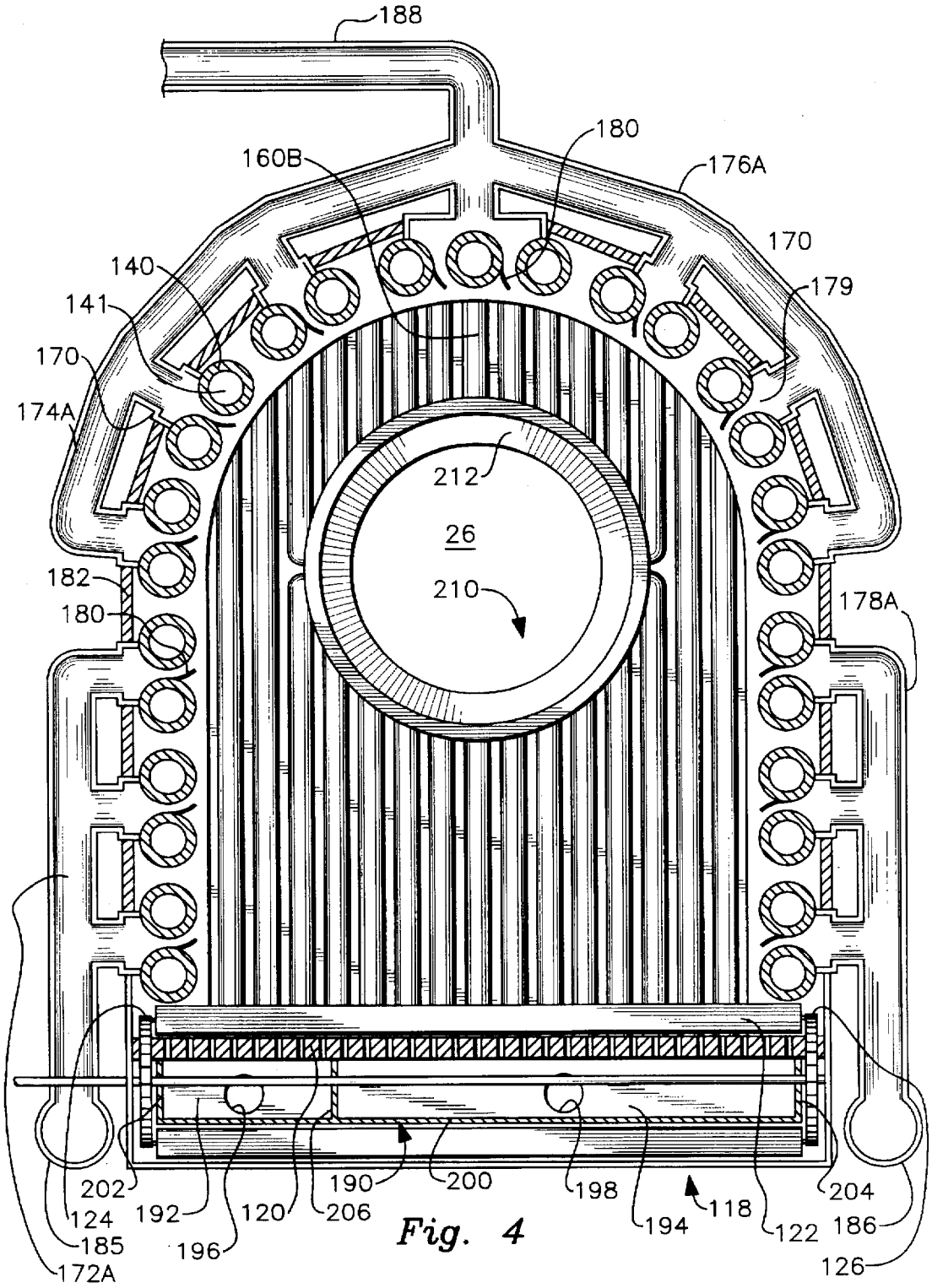
FIG. 4 is a cross-section taken on line 4—4 of FIG. 3.

More particularly, each of the forced draft air supply manifolds 170 is longitudinally divided into three zones, for example by a set of two barriers, such as barrier plate 184 in FIG. 3B. In FIG. 3, it will be appreciated that the leftmost zones of the air manifolds 170 near the furnace entry end 102 are supplied by forced draft air supply conduits 172A, 174A, 176A and 178A (FIG. 4). The longitudinal middle zones of the air manifolds 170 are supplied by air supply conduits 172B, 174B, 176B and 178B (corresponding to 178A but not visible). The rightmost zones of the air manifolds 170 near the furnace exit end 104 are supplied by air supply conduits 172C, 174C, 176C and 178C (corresponding to 178A but not visible).

In addition to the three longitudinal zones, at least four peripheral zones are established by the arrangement of air supply conduits. Thus, air supply conduits 172A, 172B and 172C define a first peripheral zone; air supply conduits 174A, 174B and 174C define a second peripheral zone; air supply conduits 176A, 176B and 176C define a third peripheral zone; and air supply conduits 178A and the corresponding but not visible air supply conduits 178B and 178C define a fourth peripheral zone.

For purposes of illustration only, the forced draft air supply conduits 172A, 172B and 172C are in turn supplied from a first main conduit 185, and the air supply conduits 178A, 178B and 178C are in turn supplied from a second main conduit 186. Air supply conduits 174A and 176A are in turn supplied from a conduit 187; air supply conduits 174B and 176B are in turn supplied from a conduit 188, and air supply conduits 174C and 176C are in turn supplied from a conduit 189. In the illustrated embodiment, forced draft airflow to the various zones is controlled simply by selecting relative conduit size. However, it will be appreciated that various adjustable airflow control dampers (not shown) and a number of air supply blowers (not shown) preferably are provided to facilitate individual zone airflow control.

Figure 5:
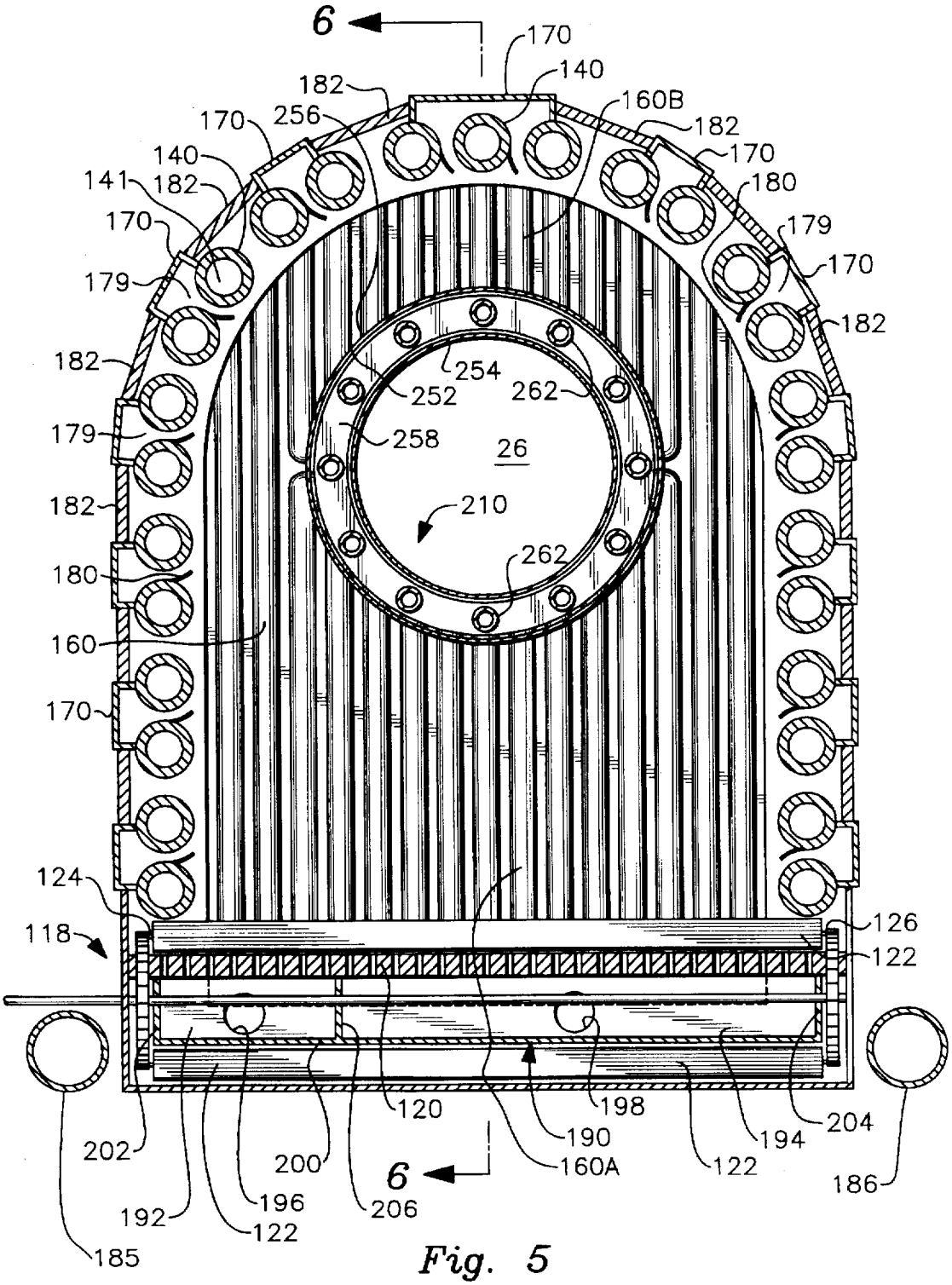
FIG. 5 is a similar cross-section taken on line 5—5 of FIG. 3B, cutting through a portion of the cylindrical structure.

In addition to the zoned manifold 170 arrangement, as is best seen in FIGS. 4 and 5 the slotted floor grate 120 comprises the top of a zoned floor grate plenum chamber 190, having sub-chambers 192 and 194 supplied via respective openings 196 and 198. The floor grate plenum chamber 190 has a bottom wall 200, sidewalls 202 and 204, and an intermediate divider 206. Air from the pressurized sub-chambers 192 and 194 is directed upwardly between the longitudinally-extending floor grate bars 120. The sub-chamber 192 is maintained at a higher pressure than the sub-chamber 194, thus further promoting vortex gas flow.

Air flowing upwardly from the floor grate plenum chamber 190 serves several purposes, including aiding the suspension of the vortex-cyclone combustion zone 23, contributing to the supply of combustion air, cooling the floor grate 120, and cooling the ash and recyclable metals. Compared to a mass burn incinerator grate, the floor grate 120 can be much smaller, for example one-third the size of a mass burn grate.

The exit port 26 more particularly takes the form of a central exhaust gas opening in the end wall 108 comprising the vertical tubes 160 and reflective refractory material 162, and is surrounded by a cylindrical structure 210 extending from the end wall 108 into the combustion chamber to a circular leading edge 212 made of a durable material such as Inconel alloy. The cylindrical structure 210, in the manner of a cyclone separator, serves to minimize the amount of particulate matter which exits through the exit port 26. If the cylindrical structure 210 is not provided, this non-combustible particulate matter tends undesirably to be drawn out through the exit port 26. With the cylindrical structure 210 present, non-combustible particulate matter is propelled by centrifugal force past the sides of the cylindrical structure 210, and is eventually discharged through the lower outlet opening 110 into the hopper 32 (FIG. 1).

Figure 6:
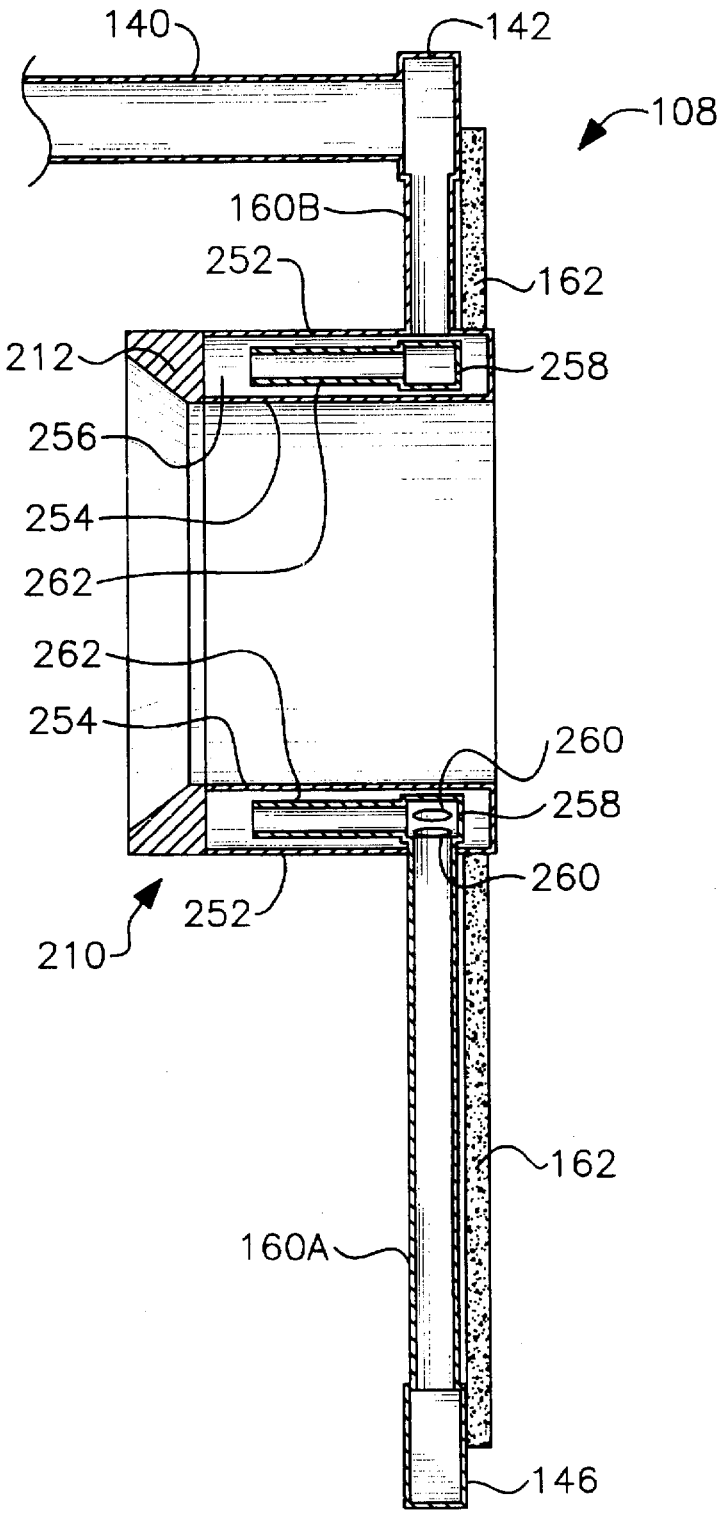
FIG. 6 is a portion of a cross-section taken on line 6—6 of FIG. 5.

With reference to FIGS. 5 and 6, the cylindrical structure 210 has a hollow wall which is water-cooled (thus serving also as a heat exchanger). In the illustrated embodiment, the water circulation path within the cylindrical structure 26 is in effect interposed in series with several of the vertical end wall tubes 160, which in FIGS. 5 and 6 are designated 160A and 160B. The cylindrical structure 212 includes a hollow wall with an outer cylindrical portion 252 and an inner cylindrical portion 254, which together define a water-filled interior space 256. Within this interior space 256 is an annular ring-like water distribution manifold 258 supplied from the water header horizontal lower section 146 via the lower vertical pipes 160A. These lower pipes 160A extend through the outer cylindrical wall 252 in a sealed manner, and connect to the interior of the ring-like water distribution manifold 258 through openings 260.

Within the interior space 256 a series of conduits 262 extend from the ring-like water distribution manifold 258 towards the leading edge 212, and discharge water into the interior space 256 near the leading edge 212.

The upper segments 160B of the vertical end wall tubes which are connected to the upper portion of the arched header 142 are connected to the outer wall 252 for carrying water out of the interior space 256.

For operation, the combustion process is begun by starting the auxiliary fuel burner 106 and other ignition devices (not shown), while solid waste material is injected through the entry port 24. Once temperatures reach a level where the combustion process is self-sustaining, the gas assist is turned off, or co-fired with the waste. Thus, once combustion temperatures reach approximately 1500° F. (approximately 800° C.), the combustion of fossil fuel and solid waste material begins immediately upon injection into the combustion chamber 22.

Relatively large mass solid waste material objects, such as objects exceeding two pounds and cross-sectional diameters of six inches or more, which are injected into the combustion chamber fall to the conveyor 118 grate 120, whereupon exposure to extreme temperatures causes combustible material to rapidly explode from surfaces of the objects. Large mass objects are thus converted into super heated gas which becomes part of the swirling turbulent vortex combustion zone 23, and travels longitudinally along the combustion chamber 22.

Lightweight combustible shredded objects injected through the entry port 24, such as cardboard, paper, plastics, and household garbage, move towards the center of the combustion furnace 22 by pneumatic assist. As combustion occurs, these lightweight combustible objects move in the swirling turbulent vortex-cyclone combustion zone 23 through the combustion furnace 22. Combustion is complete prior to the exit of combustion gases through the exhaust port 26.

Thus, combustible solid waste material is subject to thermal destruction by combustion temperatures in excess of 2000° F., which are achieved as a result of the intimate, homogeneous mixture of fuel and combustion air.

Noncombustible metal objects such as steel cans eventually free fall by gravity into the ash collection system 30 from the discharge end of the air cooled drag conveyor 118.

It will be appreciated that the solid waste incinerator system of the invention can be employed for power generation, as well as waste incineration. Thus, a power plant can advantageously generate electric power while, at the same time, disposing of municipal solid waste, for highly cost-effective operation. Apparatus of the invention can either be employed in new power plant designs, or be retrofitted to existing fossil fueled power generating plants.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. Combustion apparatus comprising:

walls defining a combustion chamber having a vortex-cyclone suspended combustion zone, whereby centrifugal force created by the cyclone effect moves non-combustible particulate matter to the outside of the combustion zone and vortex motion provides increased gas residence and particulate contact time;

at least a portion of each of said walls comprising a plurality of tubes which are adjacent and spaced from each other, said tubes having tube interiors and tube walls;

at least one tube heat exchange fluid supply pump connected to said tubes for circulating heat exchange fluid through said tubes; and a system comprising a set of manifolds for directing combustion-supporting gas streams between at least some of said tubes into said combustion chamber.

2. The combustion apparatus of claim 1, wherein the heat exchange fluid is water.

3. The combustion apparatus of claim 1, wherein said system for directing combustion-supporting gas streams between at least some of said tubes is zoned, whereby different ratios of combustion-supporting gas to fuel are achieved within different portions of the combustion zone.

4. The combustion apparatus of claim 1, which further comprises vanes attached to said tubes for tangentially directing combustion-supporting gas streams into said combustion chamber for promoting vortex gas flow and for producing an overfire gas curtain around the combustion zone.

5. The combustion apparatus of claim 1, which comprises a horizontal tunnel-shaped structure wherein solid waste material is introduced near an entry end and exit ports for hot gas and ash are provided at an exit end.

6. The combustion apparatus of claim 5, which further comprises:

an end wall at said exit end having a central exhaust gas opening; and a lower outlet opening at said exit end for non-combustible particulates;

whereby centrifugal separation force tends to direct non-combustible particulates to said lower outlet opening and to direct gas flow with reduced non-combustible particulate content out through said central exhaust gas opening.

7. The combustion apparatus of claim 6, which further comprises a cylindrical structure surrounding said central exhaust opening and extending from said end wall into said combustion chamber to a circular leading edge for minimizing non-combustible particulate content in the gas flow directed out through said central exhaust gas opening.

8. The combustion apparatus of claim 7, wherein said cylindrical structure includes a wall cooled by circulating heat exchange fluid.

9. The combustion apparatus of claim 8, wherein said end wall comprises a plurality of tubes through which heat exchange fluid is circulated, and wherein a flow path for circulating heat exchange fluid includes at least some of said end wall tubes and said cylindrical structure.

10. The combustion apparatus of claim 7, wherein said cylindrical structure includes a hollow wall within which heat exchange fluid circulates.

11. The combustion apparatus of claim 10, which comprises a plurality of conduits within said hollow wall conveying heat exchange fluid within said conduits towards said leading edge and discharging heat exchange fluid into the interior of said hollow wall near said leading edge.

12. The combustion apparatus of claim 11, wherein:

said end wall comprises a plurality of tubes through which heat exchange fluid is circulated; and which further comprises a plurality of conduits within said hollow wall conveying heat exchange fluid within said conduits towards said leading edge and discharging heat exchange fluid into the interior of said hollow wall near the leading edge; and wherein;

said conduits within said hollow wall and the interior of said hollow wall are connected in a flow path with at least some of said end wall tubes.

13. The combustion apparatus of claim 7, wherein said recovery hopper is maintained at a lower pressure than the combustion chamber.

14. The combustion apparatus of claim 6, wherein said lower outlet opening communicates with a recovery hopper.

15. The combustion apparatus of claim 6, which further comprises a drag conveyor within said tunnel-shaped structure for conveying non-suspended objects towards said exit end and discharging non-combustible material through said lower outlet opening, said drag conveyor including a grate with combustion-supporting gas streams directed upwardly through said conveyor grate.

16. The combustion apparatus of claim 5, which further comprises a drag conveyor within said tunnel-shaped structure for conveying non-suspended objects towards said exit end, said drag conveyor including a grate with combustion-supporting gas streams directed upwardly through said conveyor grate.

17. Combustion apparatus comprising:

walls defining a combustion chamber having a vortex-cyclone suspended combustion zone, whereby centrifugal force created by the cyclone effect moves non-combustible particulate matter to the outside of the combustion zone and vortex motion provides increased gas residence and particulate contact time;

said combustion chamber having the form of a horizontal tunnel-shaped structure wherein solid waste material is introduced near an entry end and exit ports for hot gas and ash are provided at an exit end;

an end wall at said exit end having a central exhaust gas opening;

a cylindrical structure surrounding said central exhaust opening and extending from said end wall into said combustion chamber to a circular leading edge for minimizing non-combustible particulate content in the gas flow directed out through said central exhaust gas opening; and a lower outlet opening at said exit end for non-combustible particulates;

whereby centrifugal separation force tends to direct non-combustible particulates to said lower outlet opening and to direct gas flow with reduced non-combustible particulate content out through said central exhaust gas opening.

18. The combustion apparatus of claim 17, wherein said cylindrical structure includes a wall cooled by circulating heat exchange fluid.

19. The combustion apparatus of claim 18, wherein said end wall comprises a plurality of tubes through which heat exchange fluid is circulated, and wherein a flow path for circulating heat exchange fluid includes at least some of said end wall tubes and said cylindrical structure.

20. The combustion apparatus of claim 17, wherein said cylindrical structure includes a hollow wall within which heat exchange fluid circulates.

21. The combustion apparatus of claim 20, which comprises a plurality of conduits within said hollow wall conveying heat exchange fluid, within said conduits towards said leading edge and discharging heat exchange fluid into the interior of said hollow wall near said leading edge.

22. The combustion apparatus of claim 17, wherein said lower outlet opening communicates with a recovery hopper.

23. The combustion apparatus of claim 22, wherein said recovery hopper is maintained at a lower pressure than the combustion chamber.

24. The combustion apparatus of claim 17, which further comprises a drag conveyor within said tunnel-shaped structure for conveying non-suspended objects towards said exit end, said drag conveyor including a grate with combustion-supporting gas streams directed upwardly through said conveyor grate.

25. A system for burning refuse-derived fuel, said system comprising:

a preheat kiln for receiving and preheating with oxygen-depleted hot gas material to be combusted;

a combustion furnace including walls defining a combustion chamber having a vortex-cyclone suspended combustion zone, whereby centrifugal force created by the cyclone effect moves non-combustible particulate matter to the outside of the combustion zone and vortex motion provides increased gas residence and particulate contact time, at least a portion of each of said walls comprising a plurality of tubes which are adjacent and spaced from each other, said tubes having tube interiors and tube walls, at least one tube heat exchange fluid supply pump connected to said tubes for circulating heat exchange fluid through said tubes, and a system comprising a set of manifolds for directing combustion-supporting gas streams between at least some of said tubes into said combustion chamber;

said combustion furnace providing hot gas as a product of combustion; and a hot gas supply conduit for circulating a portion the hot gas produced as a product of combustion through said preheat kiln as the oxygen-depleted hot gas.

26. The system of claim 25, wherein the heat exchange fluid is water.

27. The system of claim 25, wherein said system for directing combustion-supporting gas streams between at least some of said tubes is zoned, whereby different ratios of combustion-supporting gas to fuel are achieved within different portions of the combustion zone.

28. The system of claim 25, which further comprises vanes attached to said tubes for tangentially directing combustion-supporting gas streams into said combustion chamber for promoting vortex gas flow and for producing an overfire gas curtain around the combustion zone.

29. The system of claim 25, wherein said combustion furnace comprises a horizontal tunnel-shaped structure wherein solid waste material is introduced near an entry end and exit ports for hot gas and ash are provided at an exit end.

30. The system of claim 29, wherein said combustion furnace further comprises:

an end wall at said exit end having a central exhaust gas opening; and a lower outlet opening at said exit end for non-combustible particulates;

whereby centrifugal separation force tends to direct non-combustible particulates to said lower outlet opening and to direct gas flow with reduced non-combustible particulate content out through said central exhaust gas opening.

31. The system of claim 30, wherein said combustion furnace further comprises a cylindrical structure surrounding said control exhaust opening and extending from said end wall into said combustion chamber to a circular leading edge for minimizing non-combustible particulate content in the gas flow directed out through said central exhaust gas opening.

32. The system of claim 31, wherein said cylindrical structure includes a wall cooled by circulating heat exchange fluid.

33. The system of claim 32, wherein said end wall comprises a plurality of tubes through which heat exchange fluid is circulated, and wherein a flow path for circulating heat exchange fluid includes at least some of said end wall tubes and said cylindrical structure.

34. The system of claim 31, wherein said cylindrical structure includes a hollow wall within which heat exchange fluid circulates.

35. The system of claim 34, which comprises a plurality of conduits within said hollow wall conveying heat exchange fluid within said conduits towards said leading edge and discharging heat exchange fluid into the interior of said hollow wall near said leading edge.

36. The system of claim 35, wherein:

said end wall comprises a plurality of tubes through which heat exchange fluid is circulated; and which further comprises a plurality of conduits within said hollow wall conveying heat exchange fluid within said conduits towards said leading edge and discharging heat exchange fluid into the interior of said hollow wall near the leading edge; and wherein said conduits within said hollow wall and the interior of said hollow wall are connected in a flow path with at least some of said end wall tubes.

37. The system of claim 30, wherein said lower outlet opening communicates with a recovery hopper.

38. The system of claim 37, wherein said recovery hopper is maintained at a lower pressure than the combustion chamber.

39. The system of claim 30, wherein said combustion furnace further comprises a drag conveyor within said tunnel-shaped structure for conveying non-suspended objects towards said exit end and discharging non-combusted material through said lower outlet opening, said drag conveyor including a grate with combustion-supporting gas streams directed upwardly through said conveyor grate.

40. The system of claim 29, wherein said combustion furnace further comprises a drag conveyor within said tunnel-shaped structure for conveying non-suspended objects towards said exit end, said drag conveyor including a grate with combustion-supporting gas streams directed upwardly through said conveyor grate.

* * * * *